US009814936B1

(12) United States Patent
Bucolo

(10) Patent No.: US 9,814,936 B1
(45) Date of Patent: Nov. 14, 2017

(54) HEIGHT TARGET SCORING DEVICE

(71) Applicant: Angelo Bucolo, Garden City, NY (US)

(72) Inventor: Angelo Bucolo, Garden City, NY (US)

( * ) Notice: Subject to any disclaimer, the term of this patent is extended or adjusted under 35 U.S.C. 154(b) by 0 days.

(21) Appl. No.: 15/146,332

(22) Filed: May 4, 2016

(51) Int. Cl.

| | |
|---|---|
| ***A63B 71/00*** | (2006.01) |
| ***A63B 26/00*** | (2006.01) |
| ***A63B 25/08*** | (2006.01) |
| ***A63B 24/00*** | (2006.01) |
| ***A63B 21/06*** | (2006.01) |

(52) U.S. Cl.
CPC ..... *A63B 24/0062* (2013.01); *A63B 21/0604* (2013.01); *A63B 2024/0068* (2013.01)

(58) Field of Classification Search
CPC ..... A63B 24/0062; A63B 21/0604; A63B 2024/0068; A63B 24/0075; A63B 5/00–5/22; A63B 6/00–6/025; A63B 2244/08–2244/088
USPC ..... 482/8, 9, 15–18, 26–32, 77, 148
See application file for complete search history.

(56) References Cited

U.S. PATENT DOCUMENTS 3,006,644 A * 10/1961 Usher ..... A63B 23/02 116/222
3,258,266 A * 6/1966 Kamish ..... A63B 5/00 33/833
3,795,396 A * 3/1974 Kropelnitski ..... A63B 5/16 116/202
4,208,050 A * 6/1980 Perrine ..... A63B 5/16 473/447
4,323,234 A * 4/1982 Glaese ..... A63B 5/00 116/335
4,693,598 A * 9/1987 Sehr ..... G01C 15/006 33/293
4,932,137 A * 6/1990 Haley ..... A63B 5/16 273/454
5,031,903 A * 7/1991 Clarke ..... A63B 5/16 473/447
5,072,931 A * 12/1991 Carlson ..... A63B 5/00 473/447
5,838,638 A * 11/1998 Tipton ..... A63B 5/16 368/10
6,181,647 B1 * 1/2001 Tipton ..... A63B 5/16 368/10
7,097,589 B2 * 8/2006 Underwood ..... A63B 5/00 473/447
7,182,704 B2 * 2/2007 Levy ..... A63B 69/0071 273/317.3

(Continued)

*Primary Examiner* — Stephen R Crow
*Assistant Examiner* — Garrett Atkinson
(74) *Attorney, Agent, or Firm* — Day Pitney LLP

(57) ABSTRACT

The present invention provides a height target exercise scoring device comprising a pad adapted to absorb repeated impacts, the pad including a front exposed surface, a rear surface adapted to be mounted onto a wall, and an array of impact sensors positioned beneath the exposed surface. The target height exercise scoring device also includes a housing coupled to the pad including a control system. The control system includes an interface for inputting a target height parameter, and a processor coupled to the array of impact sensors configured to determine whether an impact registered by the array of impact sensors occurs on the pad at or above the input target height, and to generate feedback signals corresponding to whether the impact has or has not occurred at the target height.

15 Claims, 8 Drawing Sheets

(56) References Cited

U.S. PATENT DOCUMENTS

| | | | | |
|---|---|---|---|---|
| 7,361,104 | B2 * | 4/2008 | Levy | A63B 69/0071 273/317.3 |
| 7,530,925 | B2 * | 5/2009 | Underwood | A63B 5/16 482/148 |
| 7,984,696 | B2 * | 7/2011 | Horrocks | A63K 3/046 119/705 |
| 9,017,222 | B2 * | 4/2015 | Hofeldt | A63B 5/00 482/15 |
| 2003/0077556 | A1 * | 4/2003 | French | A61B 5/1113 434/258 |
| 2005/0069853 | A1 * | 3/2005 | Tyson | A61B 5/0002 434/247 |
| 2005/0130772 | A1 * | 6/2005 | Levy | A63B 69/0071 473/433 |
| 2007/0129180 | A1 * | 6/2007 | Levy | A63B 69/0071 473/415 |
| 2010/0129780 | A1 * | 5/2010 | Homsi | A63B 24/0062 434/258 |
| 2012/0130514 | A1 * | 5/2012 | Homsi | A63B 24/0062 700/91 |
| 2012/0130515 | A1 * | 5/2012 | Homsi | G06F 19/3481 700/91 |
| 2014/0074265 | A1 * | 3/2014 | Arginsky | G06F 19/3481 700/91 |
| 2017/0050096 | A1 * | 2/2017 | Bentley | A63B 69/00 |

* cited by examiner

HEIGHT TARGET SCORING DEVICE

FIELD OF THE INVENTION

The present invention relates to an apparatus used for sports practice, and more specifically relates to a scoring device for height target exercises such as wall ball and handstanding and other exercise or sports applications where a target is desired.

BACKGROUND OF THE INVENTION

Wall ball is an exercise that combines a squat and a push press and is considered to be useful for cross-fit training. In the exercise, the trainee first squats facing a wall while holding a ball (referred to as a "medicine ball") and then rises while propelling the ball upwards toward a height target on the wall. The ball rebounds from the wall and the trainee catches the ball while descending back into a squat position. Another height target exercise is a hand-stand push up movement where a repetition is counted (scored) when the trainee pushes up from the floor and their heels reach a certain height.

SUMMARY OF THE INVENTION

The present invention is intended to provide a convenient device that provides feedback for exercises having as a goal the reaching of a target height. Wall ball and handstand-pushup movements are two such exercises, though it is envisioned within the scope of the application that the present invention could be used in connection with other sports or exercise techniques.

In this regard, the present invention provides a target height exercise scoring device that comprises a pad adapted to absorb repeated impacts, the pad including a front exposed surface, a rear surface adapted to be mounted onto a wall, and an array of impact sensors positioned beneath the exposed surface. The device also includes a housing coupled to the pad including a control system. The control system includes an interface for inputting a target height parameter, and a processor coupled to the array of impact sensors configured to determine whether an impact registered by the array of impact sensors occurs at or above the input target height on the pad, and to generate feedback signals corresponding to whether the impact has or has not occurred at the target height.

The present invention also provides a method of providing feedback for a height target exercise using a device comprising a mounted pad adapted to absorb impacts, the pad including a front exposed surface and an array of impact sensors positioned beneath the exposed surface, the device also including a housing coupled to the pad including a control system configured to receive input of a target height and to determine whether an impact registered by the array of impact sensors occurs on the pad at or above the input target height, and to generate feedback signals corresponding to whether the impact has or has not occurred at the target height. The method comprises detecting an impact on the pad, determining whether the impact has occurred at or above a target height, and generating a feedback signal corresponding to whether or not the target height has been reached by the impact.

DETAILED DESCRIPTION

Figure 1:
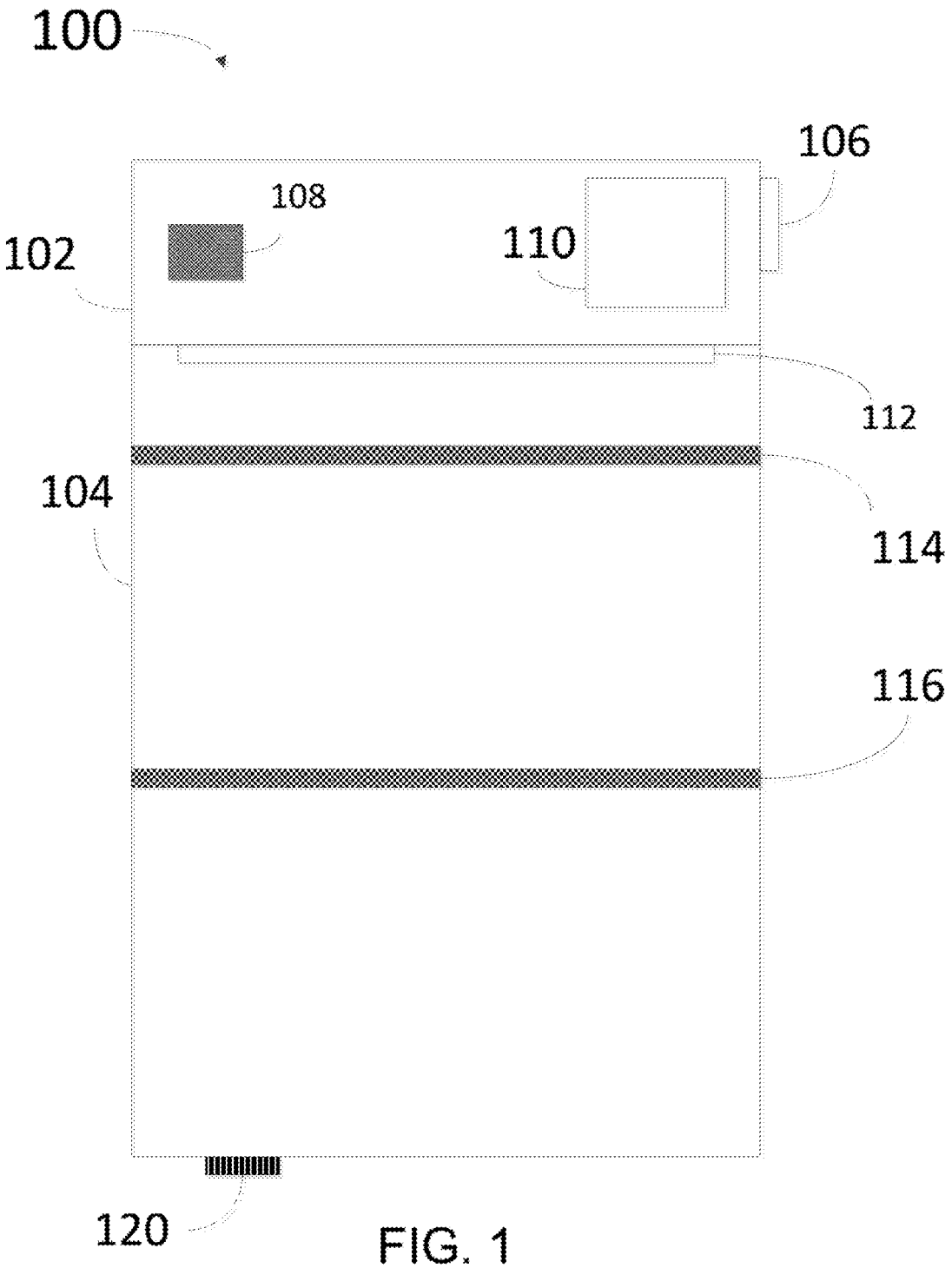
FIG. 1 is a schematic front plan view of a target height scoring device according to an exemplary embodiment of the present invention.

Reference is now made to FIG. 1, which shows a front view of a height target scoring device 100 according to an exemplary embodiment of the present invention. The device 100 as shown is rectangular in outline and elongated vertically. The device 100 includes a housing portion 102 (referred to herein as the "housing") and an impact-registering pad portion 104 (referred to herein as the "pad"). The device 100 is intended to be mounted vertically on a wall with the housing 104 at the top. The housing 102 includes electronic processing components (not shown in FIG. 1) configured to: register when a ball strikes the pad 104, determine the relative height on the pad at which impacts occur, determine the absolute height (from the floor) corresponding to the relative height, and generate output signals for alerting the trainee whether or not an impact occurs at a target height. Additional operations performed by the electronics include keeping a score of the number of times an impact occurs at a target height during an exercise session, recording user settings and calculating statistics related to exercise performance.

The housing 104 also includes a control panel 106, a speaker 108 and a main display 110. The control panel 106 may include a keypad, buttons, sliders, or other similar input elements for receiving user settings and a display such as an LCD panel for displaying the received settings. The main display 110 may include one or more LEDs, a video screen or other visual feedback output elements. In one embodiment, the main display 110 flashes green when a ball impact reaches a target height, and flashes red when the impact falls short of the target height. A lighting element 112 positioned beneath the housing may be included to illuminate the device. The wall ball scoring device 100 may be supplied power externally via a power cord (not shown) or may include a rechargeable battery, a solar panel or another source of electrical power.

Figure 2:
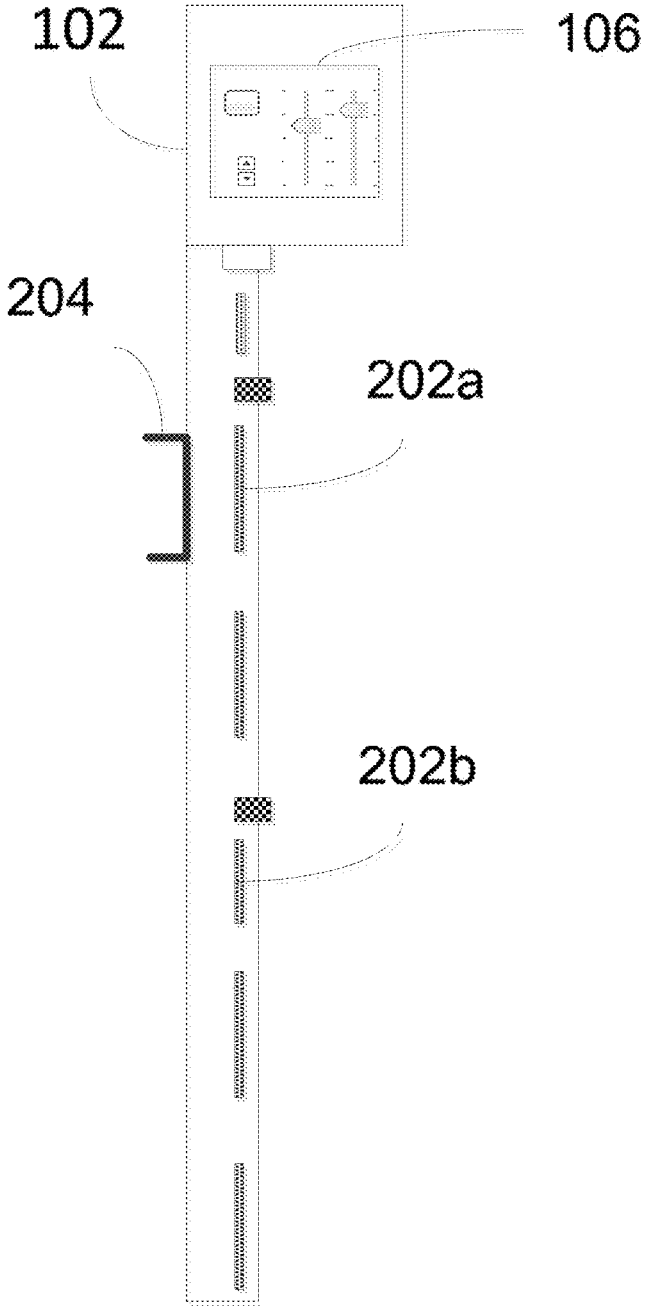
FIG. 2 is a schematic side view of a target height scoring device according to an exemplary embodiment of the present invention.

The pad 104 preferably covers a substantially rectangular area having a height which can range from a few to over twelve feet, and in the latter case may cover extend from the floor to over twelve ft. in height. The width of the pad can also range a great deal a desired from, for example, around a foot to several feet. It is noted however that other shapes and dimensions are envisioned within the scope of the invention. The surface of the pad may be made from a wide variety of textile and elastic materials including but not limited to polyurethanes, foam rubber, fabrics such as canvas, etc. and/or any combination thereof that is able to absorb numerous repeated impacts without deformation. As illustrated in FIG. 2, the pad 104 includes an array of sensor elements, which may be implemented as piezoelectric actuators, capacitive sensors, or any other convenient, low cost sensors that reliably detect impact or pressure. In some embodiments, instead of pressure or motion sensors, optical sensors responsive to the blockage of light beams at locations on the pad or acoustic sensors responsive to sound vibrations can be used. When a ball strikes the pad, the specific sensors on the pad that respond to the impact deliver analog signals to the processing components of the housing 104 and thereby the location of the impact on the pad, particularly the height on the pad, can be determined. The device 100 may also include horizontally marker bars 114, 116 extending across the pad which, in some embodiments may be vertically slidable to enable a user to mark absolute heights on the pad 104. In some embodiments, the marker bars may be secured tightly enough to the device to exert a small pressure on the pad, enabling the sensor elements to detect their positions. In other embodiments, the marker bars may be stationary and used as reference heights on the pad (for example, the markers may be lined up with measured heights). In addition, in some embodiments the wall board scoring device may also include an absolute distance sensor 120 positioned at the bottom of the device and adapted to determine the distance from the sensor to the floor.

FIG. 2 is a side view of the wall ball scoring device shown in FIG. 1. From this view the housing 102 and the pad 104 can be more clearly distinguished, with the housing having a greater depth. Sensor elements e.g., 202*a*, 202*b*, are embedded in the pad 104 at a distance sufficient to protect the sensor elements without reducing their sensitivity to impacts on the surface of the pad 104. A mounting element 204 coupled to the back of the pad may comprise a bracket or similar component for conveniently mounting the device on a wall. In the embodiment depicted the control panel 106 includes a device on/off switch 212, an initial calibration control 214, a target height control 216 and a visual feedback control 218. The visual feedback may be provided in English and foreign languages by selection. The particular configuration of controls is merely illustrative and may implemented using different arrangements of buttons or other actuators, or alternatively, they may be implemented using a single touchscreen display.

When the device is initially mounted on a wall, the device is calibrated for height because, while the pad sensors can be used to determine a 'relative' height of an impact with respect to the dimensions of the pad itself, the impact sensors themselves cannot determine the absolute height (i.e., the height measured from the floor) of an impact. There are numerous ways that the relative height coordinates of the pad sensors can be converted into absolute height values. In one embodiment, one of the marker bars, e.g., 114 is adjusted to a target absolute height, as measured using a tape measure or a known reference height, for example, 10 feet, and the height of this marker is entered using the control panel. Because the pad can sense the position of each of the marker bars, the marker position becomes an absolute height reference value for the pad. Alternatively, calibration can take place without use of marker bars and a general reference height such as the bottom edge of the device is entered using the control panel. The control panel may thereby allow selection of different calibration modes (marker bar vs. bottom edge) for calibrating the pad. In yet another alternative embodiment, a distance sensor 120 may directly measure the distance from a reference point on the device, such as the bottom edge of the device, to the floor, and may communicate this information directly or via Bluetooth to the processing components.

Figure 3:
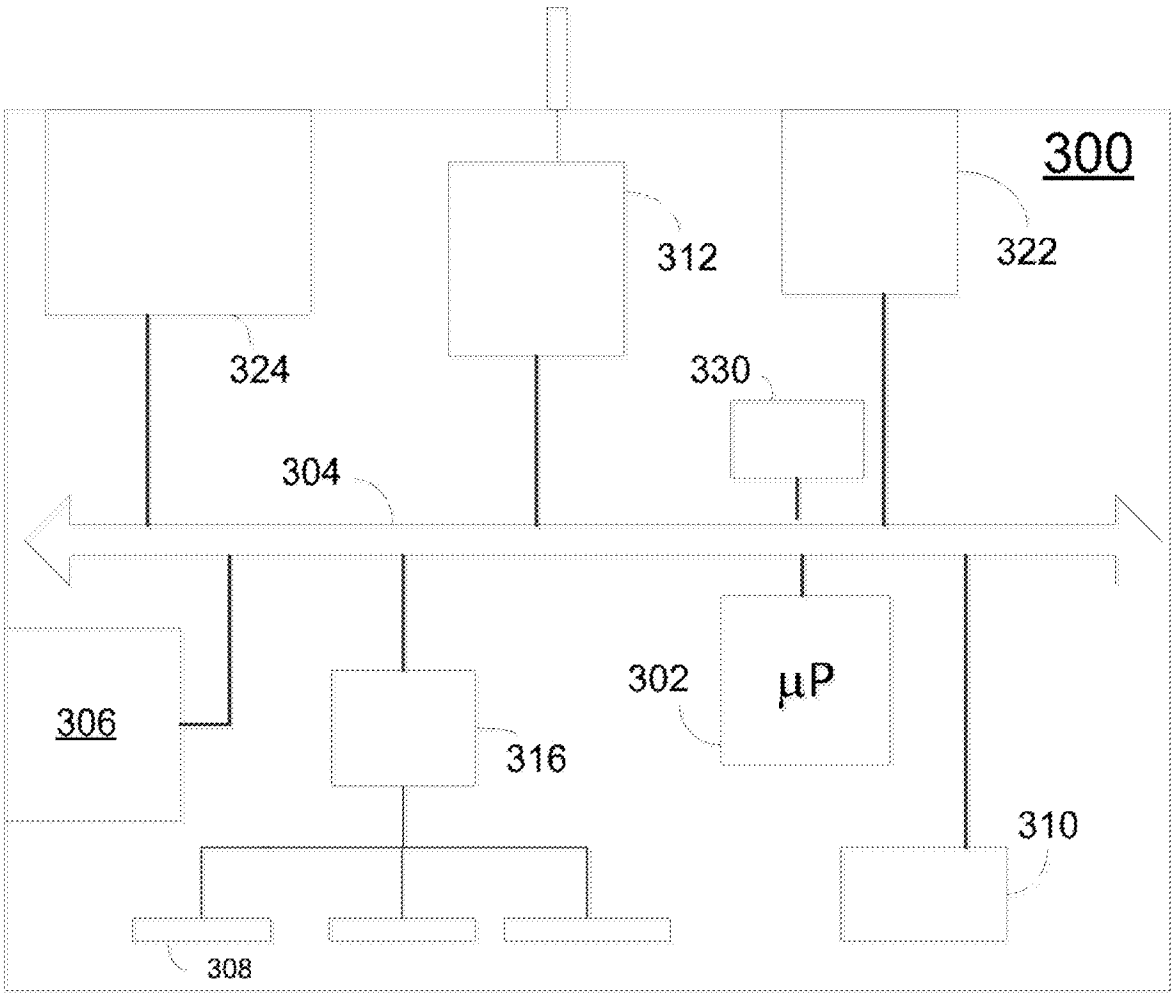
FIG. 3 is a schematic view of a control system for a target height scoring device according to an exemplary embodiment of the present invention.

FIG. 3 is a schematic diagram of an electronic processing system 300 that may be used in the height target scoring device according to an exemplary embodiment of the present invention. The system 300 includes an electronic processor 302 which may comprise a microprocessor, a programmable logic device (PLD), an application specific integrated circuit (ASIC), a field programmable gate array (FPGA) and/or any suitable processing device or control circuit. The processor 302 is coupled to an input/output bus 304 through which it sends and receives digital data to and from peripheral devices which include input devices and output devices for the scoring device. The input devices include the actuators and elements included in the control panel 306, the array of impact sensors 308, the optional absolute distance sensor 310 and a transceiver (including antenna) 312 adapted to receive wireless signals such as Wi-Fi or Bluetooth. To the extent that the input devices, such as the impact sensors produce analog signals, the signals may be conditioned and converted to digital signals suited for transport on the bus 304 via an analog/digital (A/D) converter 316. Digital signals originating or converted from all of the input devices 306-312 are encoded according to the particular device they come from and are then routed on the bus 304 to the processor 304, which receives and processes the received signals.

The processor 302, in turn, routes outputs signals along the bus for delivery to output devices including, for example, an audio device such as a speaker 322, a video display 324 and a transmitter which may be co-located with the receiver in a transceiver arrangement 312. Alternatively, the receiver and transmitter may be implemented separately. The speaker 322 may be output approximately 85-92 db at 2-4 Watts, sufficient to be clearly audible at distances of 2-4 meters, suitable for individual gym equipment use. The display may be a flat panel LED or LCD unit with length and width dimensions ranging according to the desired size of the device housing. In some embodiments the display may be approximately 4-7 inches wide and 3-6 inches long such that when a large portion of the screen is used to flash a uniform color, the flash can be easily viewed from 2-4 meters away. The system 300 also includes a memory device 330 which although depicted separately as a separate integrated circuit may be implemented on the processor itself. The memory may include RAM, flash memory and/or other read/writable memory elements.

Figure 4A:
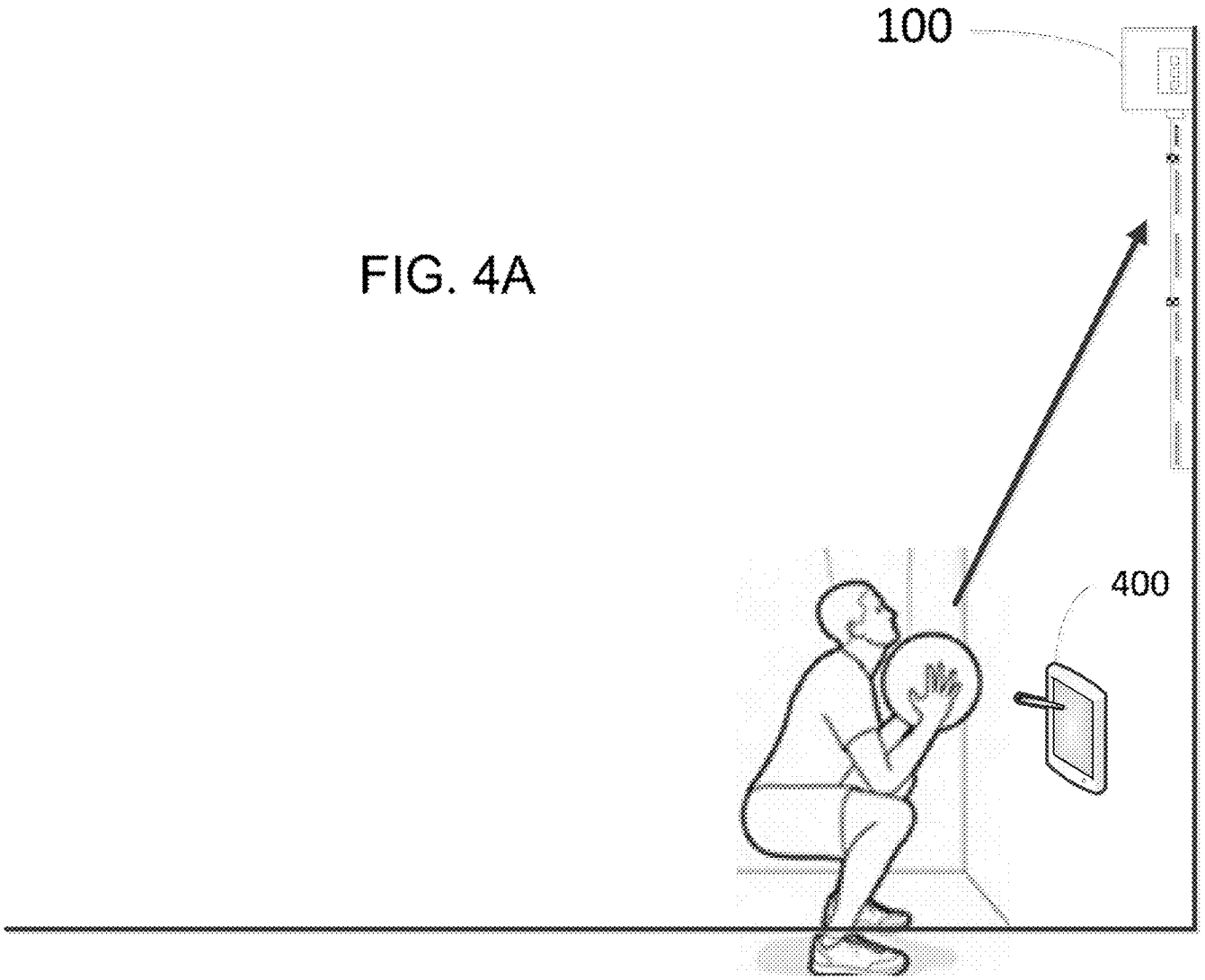
FIG. 4A is a schematic side view illustration of a first squat position in a wall ball exercise.
Figure 4B:
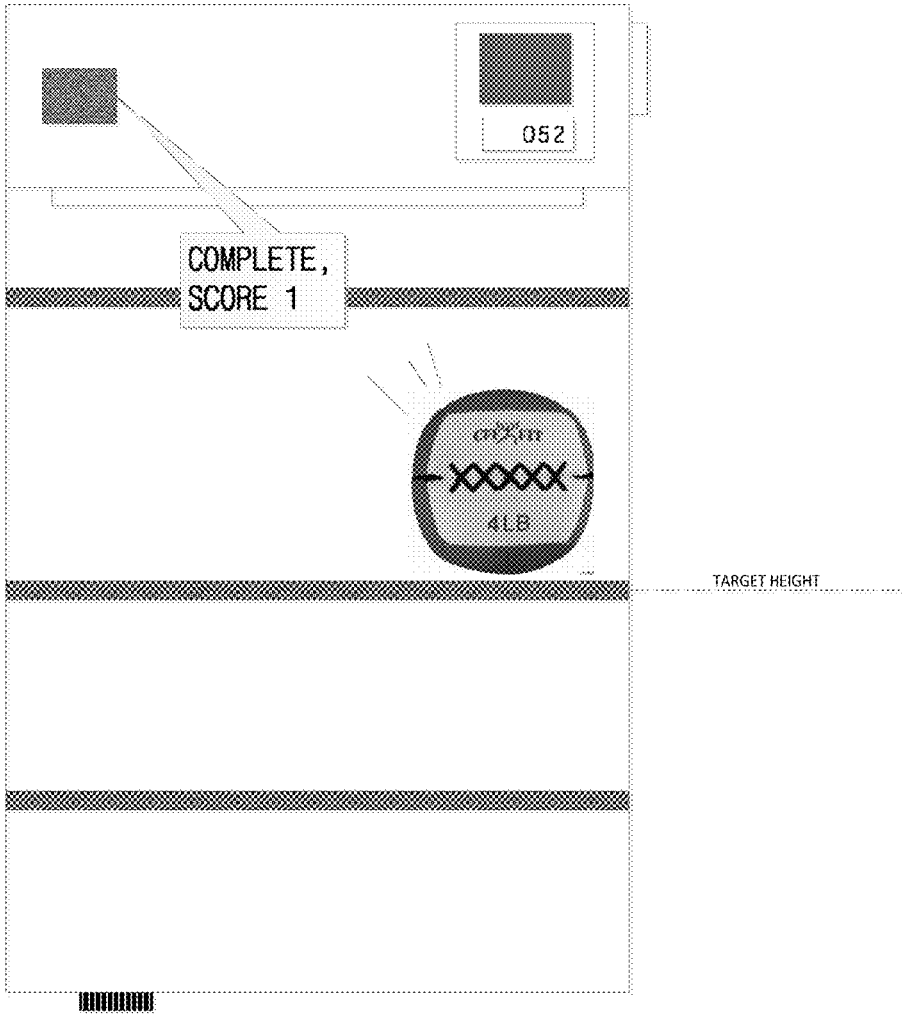
FIG. 4B is a front view of the target height scoring device illustrating an example output of feedback to the trainee indicating that the target height has been reached.

In operation, once calibration is complete using the methods of setting absolute height discussed above, the device may be used for feedback and scoring. For example, the trainee may begin a wall ball exercise by throwing a ball forward and upwards onto the pad of the device as schematically shown in FIG. 4A, which illustrates a trainee in a squat stance in position to throw a ball toward the wall ball scoring device. In an example exercise, the trainee may have set a first target height which qualifies for scoring. Thus, when a ball thrown reaches the first height (e.g., 11 ft.), the sensors on the pad will deliver signals to the processors indicative of the impact, and the processor will interpret the received signals that the ball has reached the target first height. Using the settings, the user may configure the processor to generate various responses, including but not limited to, incrementing a scoring counter by a certain value, outputting the incremented score to the video display, causing the output to display a particular color indicative that the target has been reached, or sending a signal to the speaker to output an indication of a score and the like. An illustration of an example setting is shown in FIG. 4B which shows a ball hitting the first target height. The device determines that the ball has reached the first target height as described above and generates corresponding audio feedback output (e.g., "Complete, Score 1") and a visual feedback display of a green colored square in the video display, which may flash for a set period such as a few seconds, along with a running score indicating the number of times the first target height has been reached either during the session or cumulatively, depending on configurable settings. Scores may be stored in memory according to user selection. For example, after the end of an exercise session, the user may select to have the processor store the current score in memory, associated with a name or identification of the trainee, which may then be retrieved in subsequent sessions. In this manner, the user may have a cumulative total for all sessions, a total for a selected number of sessions, or simply a current session score displayed.

In addition to supplying feedback to the trainee, the visual display and speaker can be used for other purposes, such as to play music and/or multimedia content.

Figure 4C:
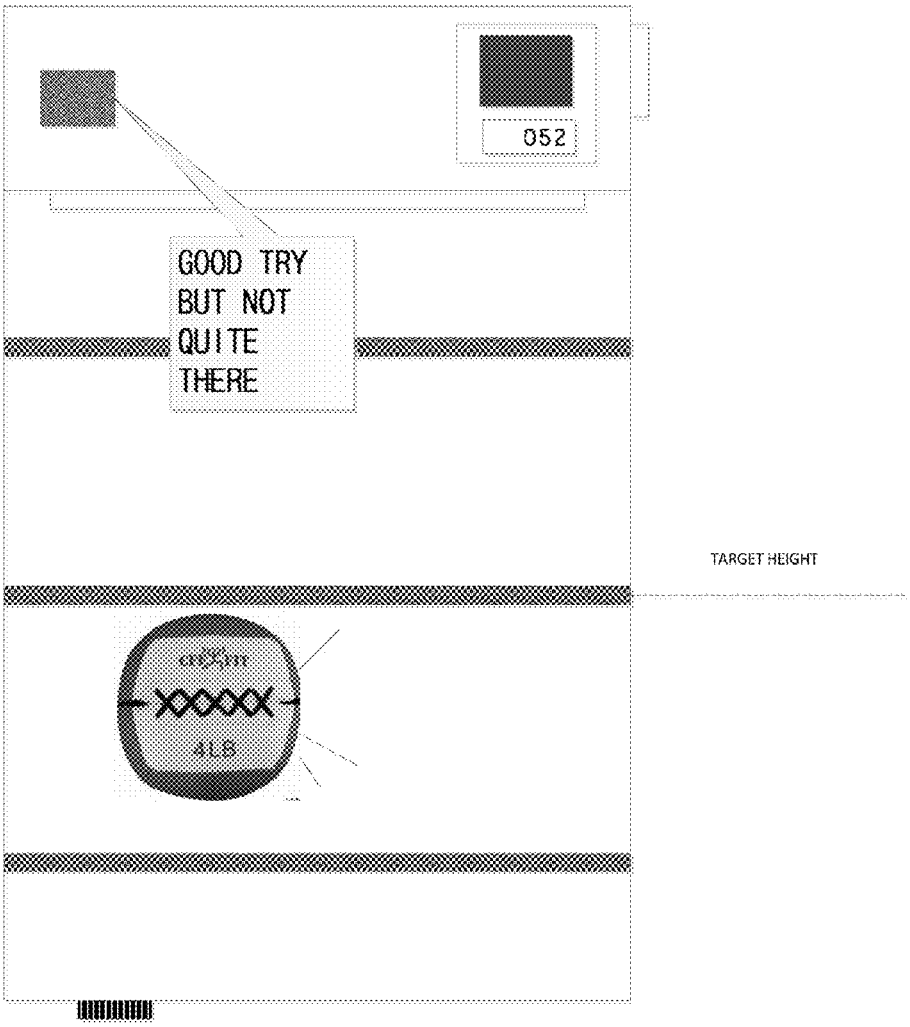
FIG. 4C is a front view of the target height scoring device illustrating an example output of feedback to the trainee indicating that the target height has not been reached.

Similarly, settings may be provided for a second target height (e.g., 10 ft.) as shown in FIG. 4C, which shows a ball hitting the second target height. The device determines that the ball has not reached the first target height, but rather has reached the second target height and generates corresponding audio feedback output (e.g., "Good try but not quite there") and a visual feedback display of a red colored square in the video display, which may flash for a set period such a few seconds. As the first target height has not be reached, in this example the score does not change.

These example exercise events are merely illustrative and other settings may be used. In some embodiments, a range of target heights may be used with a sliding score scale. For example, a ball impact at 12 ft. may increase the score by two points, an impact at 11 ft. may increase the score by one point, and an impact below 9.5 ft. may lower the score by one point. Any number of different combinations of settings, scores and alerts may be configurable by the user. Over time, the shot accuracy feedback provided by the scoring device improves shot accuracy and personal athletic performance.

Referring again to FIG. 4A, a mobile device 400, such as a smartphone or tablet, is shown. The mobile device may execute a mobile application for configuring the settings of the scoring device 100 in lieu of or in addition to using the device control panel for configuration. In some embodiments, the application may provide a user interface including controls for setting the configuration of the scoring device similar to the embedded control panel. The mobile device 400 may communicate data over a Wi-Fi or Bluetooth connection with the transceiver of the scoring device 100 through which configuration data may be sent to the scoring device and scoring data or other information stored by the scoring device may be sent back to the mobile device. In this manner, the mobile device 400 and scoring device 100 may be synchronized to one another. Alternatively, the scoring device may be synchronized to other scoring devices in a facility or to other types of scoring devices via wireless communication for configuration and scoring updates.

Figure 5:
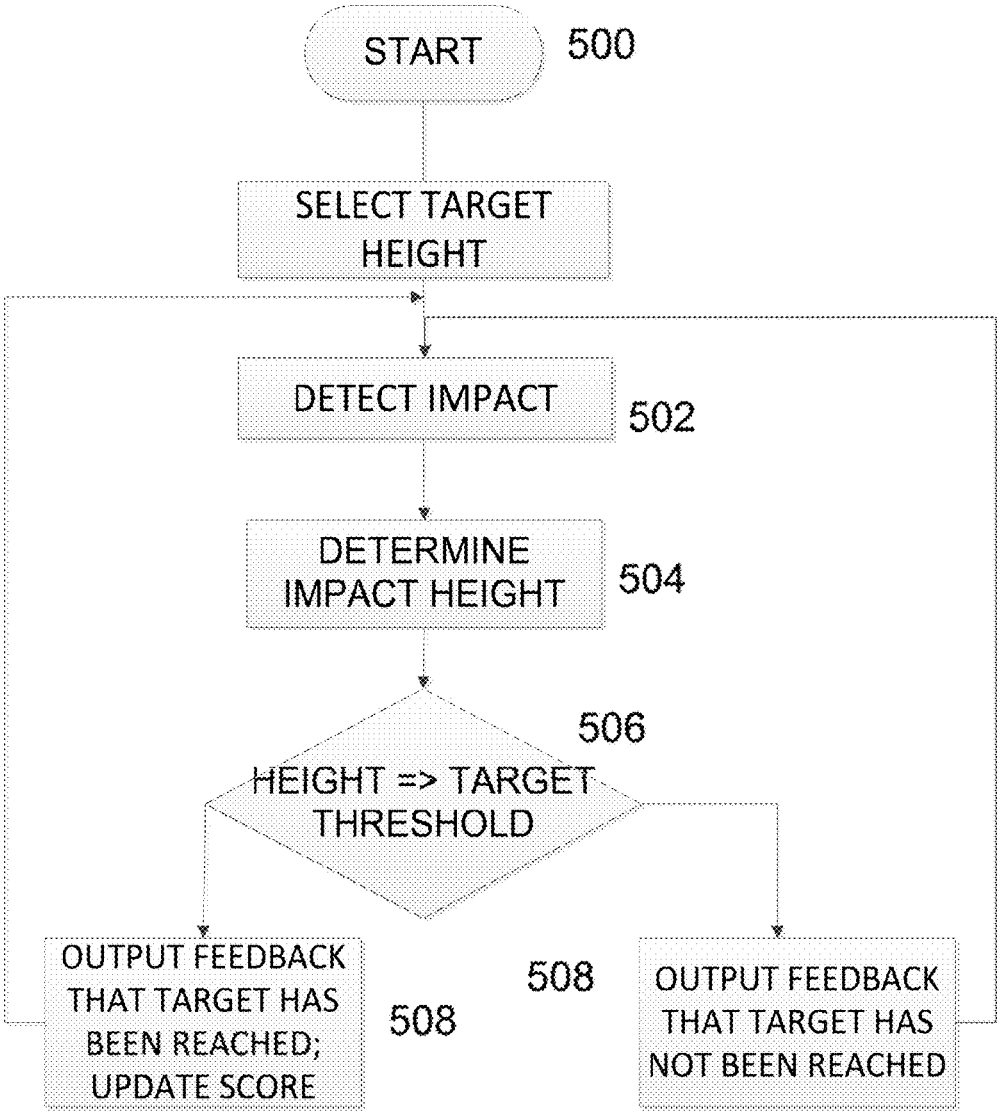
FIG. 5 is a flow chart of a method of performing a target height exercise using a target height scoring device according to an exemplary embodiment of the present invention.

FIG. 5 shows a flow chart of a general method of scoring a height target exercise such as wall ball according to an exemplary embodiment of the present invention. After a trainee turns the device on and starts an exercise session (500), the trainee may select and enter a desired target height into the control panel or via wireless signal from a mobile device (502). The trainee then starts the exercise and throws a ball toward the pad of the device. When a thrown ball impacts a section of the pad, the impacted sensors of the array send a signal to the processor (504). From the signals received from the sensors, the processor determines (506) whether the impact has occurred at or over the selected target height on the pad. If it is determined that the impact is at or over the target height, the device generates feedback to the trainee indicating that the target height has reached through audio and/or visual output and the score registered on the device may be incremented (508). If, on the other hand, it is determined that the impact was below the target height, the device generates feedback to the trainee indicating that the target height has not been reached (510). In either case, after feedback the process cycles back to detect another impact (504) and the process continues until the session ends.

Figure 6:
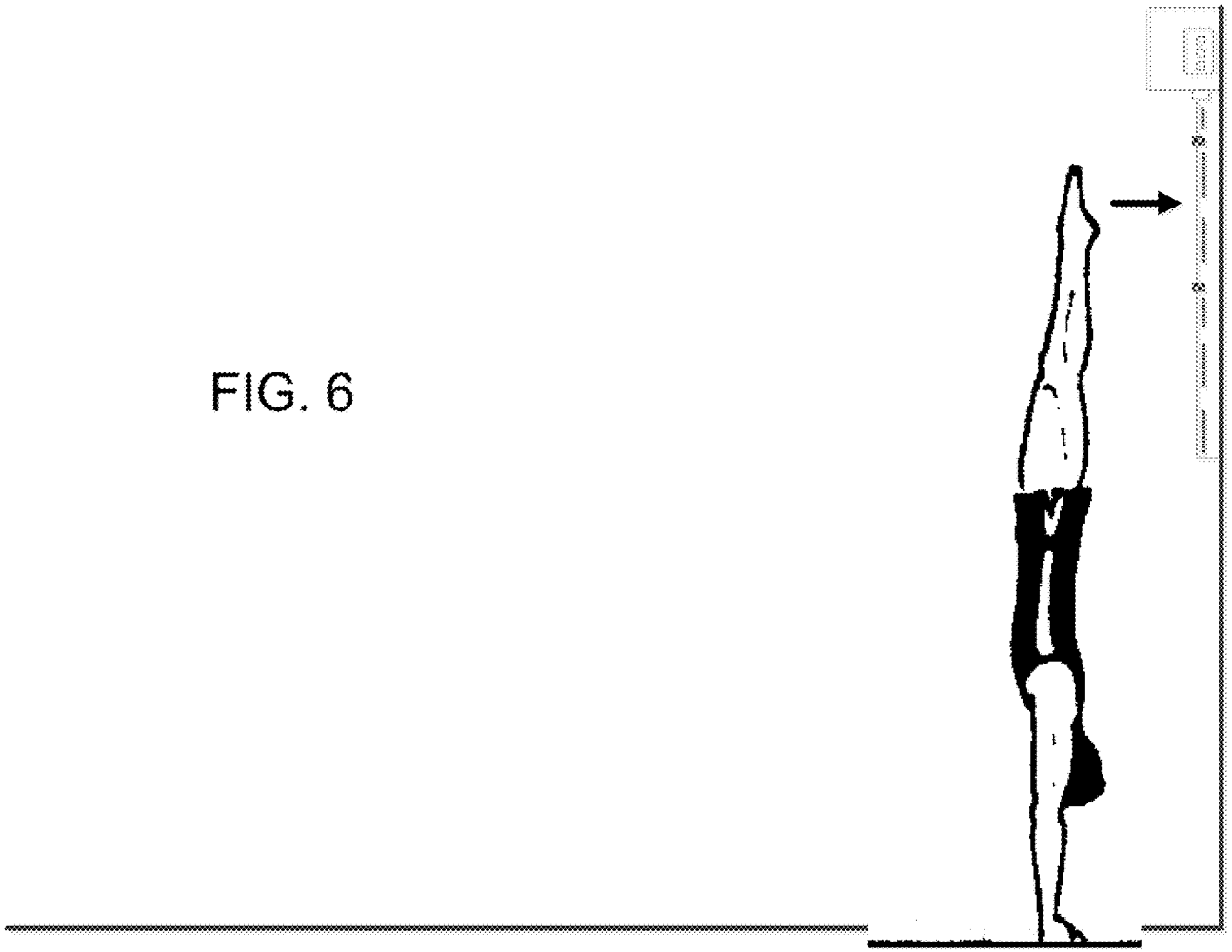
FIG. 6 is a schematic side view illustration of a position reached in a handstand-pushup movement exercise.

Although the scoring device was described as specifically implemented for a wall ball exercise, the scoring device may be used in other sporting activities for which reaching target heights is a goal, such as the handstand-pushup exercise as shown in FIG. 6, or any other exercise or sporting activity for which a target is desired for use with a hand, foot, or piece of exercise or sporting equipment. In an example embodiment, rather than registering the impact of thrown balls, the scoring device may be used to register contact of feet on the pad in a maneuver in which a trainee pushes off of from the floor with the hands while extending and raising the feet. In this exercise, the greater the extension effort, the higher the feet, or a part of the feet such as the heel, will make contact with the pad.

It will be understood by those of ordinary skill in the art that various changes may be made and equivalents may be substituted for element without departing form the scope of the invention. In addition, many modifications may be made to adapt a particular feature of material to the teachings of the invention without departing from the scope thereof. Therefore, it is intended that the invention not be limited to the particular embodiments disclosed, but that the invention will include all embodiments falling within the scope of the claims.

What is claimed is:

1. A height target exercise scoring device comprising:

a pad adapted to absorb repeated impacts, the pad including a front exposed surface, a rear surface adapted to be mounted onto a wall, and an array of impact sensors positioned beneath the exposed surface; and a housing coupled to the pad including a control system, the control system including an interface for inputting a target height parameter, and a processor coupled to the array of impact sensors configured to determine whether an impact registered by the array of impact sensors occurs on the pad at or above the input target height, and to generate feedback signals corresponding to whether the impact has or has not occurred at the target height.

2. The target height exercise scoring device of claim 1, wherein the control system further includes an audio output device and a video display device coupled to the processor for receiving the feedback signals and for generating corresponding audio and video feedback.

3. The target height exercise scoring device of claim 2, wherein the feedback signals cause the audio output device to output a first spoken message indicating the target height has been reached, and second spoken message different from the first spoken message if the target height has not been reached.

4. The target height exercise scoring device of claim 2, wherein the feedback signals cause the video display to display a first color if the target height has been reached, and a second color different from the first color if the target height has not been reached.

5. The target height exercise scoring device of claim 2, wherein processor also generates and records a numerical score indicating the number of impacts occurring above the target height and generates signals for display of the score on the video display.

6. The target height exercise scoring device of claim 1, wherein the pad is rectangular and elongated vertically.

7. The target height exercise scoring device of claim 1, further comprising:

a distance sensor coupled to the processor adapted to determine an absolute height of a reference point on the pad.

8. The target height exercise scoring device of claim 1, wherein the interface is adapted to receive user input of an absolute height of a reference point on the pad.

9. The target height exercise scoring device of claim 1, wherein the interface is adapted for input of a plurality of target height values and a scoring values corresponding to the plurality of target height values.

10. The target height exercise scoring device of claim 1, wherein the control system further includes a transceiver adapted to communicate using a wireless communication protocol.

11. A method of providing feedback for a height target exercise using a scoring device comprising a mounted pad adapted to absorb impacts, the pad including a front exposed surface and an array of impact sensors positioned beneath the exposed surface, the device also including a housing coupled to the pad including a control system configured to receive input of a target height and to determine whether an impact registered by the array of impact sensors occurs on the pad at or above the input target height, and to generate feedback signals corresponding to whether the impact has or has not occurred at the target height, the method comprising:

detecting an impact on the pad;

determining whether the impact has occurred at or above a target height; and generating a feedback signal corresponding to whether or not the target height has been reached by the impact.

12. The method of claim 11 further comprising:

outputting at least one of an audio message and a visual display corresponding to the feedback signal.

13. The method of claim 11, wherein the visual display includes an indication of whether the impact reached the target height and a current score.

14. The method of claim 11, further comprising:

determining an absolute height of a reference point on the pad.

15. The method of claim 11, further comprising:

receiving user input for configuring the target height, the audio message and the visual display.

* * * * *